US006053367A

United States Patent [19]

Pejoine

[11] Patent Number: 6,053,367

[45] Date of Patent: Apr. 25, 2000

[54] LIQUID DISTRIBUTOR

[76] Inventor: Pierre Marc Pejoine, 1, rue Antoine Dubayle, 19100, Brive, France

[21] Appl. No.: 09/130,205

[22] Filed: Aug. 4, 1998

[51] Int. Cl.[7] ..... B67D 5/06

[52] U.S. Cl. ..... 222/185.1; 222/153.01

[58] Field of Search ..... 222/185.1, 328, 222/547, 153.1, 145.1, 153.01, 153.03, 153.09; 241/199.12; 403/348, 349; D7/368, 378

[56] References Cited

U.S. PATENT DOCUMENTS

| | | | |
|---|---|---|---|
| 223,396 | 1/1880 | Shabley | 222/481.5 |
| 674,492 | 5/1901 | Birnie et al. | 222/185.1 |
| 999,602 | 8/1911 | Slee | 222/185.1 |
| 2,708,056 | 5/1955 | Reid | 222/481 |
| 3,042,267 | 7/1962 | Reynard | 222/185.1 |
| 4,386,718 | 6/1983 | Stewart et al. | 222/185.1 |
| 4,635,824 | 1/1987 | Gaunt et al. | 222/129.1 |
| 4,928,855 | 5/1990 | Ramsey | 222/131 |
| 5,240,147 | 8/1993 | Frazier et al. | 222/153.9 |
| 5,405,058 | 4/1995 | Kalis et al. | 222/185.1 |

FOREIGN PATENT DOCUMENTS

| | | | |
|---|---|---|---|
| 001379953 | 10/1964 | France | 222/185.1 |

*Primary Examiner*—Steven O. Douglas
*Assistant Examiner*—Huyen Le
*Attorney, Agent, or Firm*—Alston & Bird LLP

[57] ABSTRACT

A system for dispensing a liquid, in particular a beverage, the system comprising a container forming a supply of liquid and fitted with a dispenser device for delivering various quantities of liquid, a base for supporting the container, and a fixing device for fixing the container on the base, the system being characterized in that the fixing device comprises means of complementary shape secured respectively to the container and to the base, and co-operating with each other to enable at least relative rotary movement between the container and the base to secure them to each other or to release them from each other depending on the direction of rotation.

8 Claims, 2 Drawing Sheets

LIQUID DISTRIBUTOR

BACKGROUND OF THE INVENTION

The invention relates to a liquid dispenser, in particular for dispensing a beverage such as beer, for example.

It has been the practice for a very long time to use dispensers in the form of liquid-filled containers each fitted with a cock for delivering various quantities of liquid. Those liquid dispensers can be used in numerous fields in industry for transporting and/or storing liquids which can subsequently be transferred into individual containers such as bottles, cans, . . . . For personal or home use, such liquid dispensers are generally portable and contain a beverage which may optionally be alcoholic.

The object of the invention is to design a portable liquid dispenser which is more particularly intended for dispensing a beverage in private or public premises, and which is designed to be manufactured industrially at low cost.

SUMMARY OF THE INVENTION

To this end, the invention provides a system for dispensing a liquid, the system comprising a container forming a supply of liquid and fitted with a dispenser device for delivering various quantities of liquid, a base for supporting the container, and a fixing device for fixing the container on the base, the system being characterized in that the fixing device comprises means of complementary shape secured respectively to the container and to the base, and co-operating with each other to enable at least relative rotary movement between the container and the base to secure them to each other or to release them from each other depending on the direction of rotation.

In general, the container and the base are in alignment with each other on a substantially vertical axis, and the fixing device comprises a male portion having two lateral projections, and a female portion having two cavities for receiving the two projections of the male portion and for preventing relative movement between the container and the base in an axial direction.

The male portion of the fixing device is secured to the container and the female portion is secured to the base, or vice versa.

BRIEF DESCRIPTION OF THE DRAWINGS

Other advantages, characteristics, and details of the invention appear from the following additional description made with reference to the accompanying drawings given solely by way of example, and in which.

DETAILED DESCRIPTION OF THE PREFERRED EMBODIMENT

Figure 1:
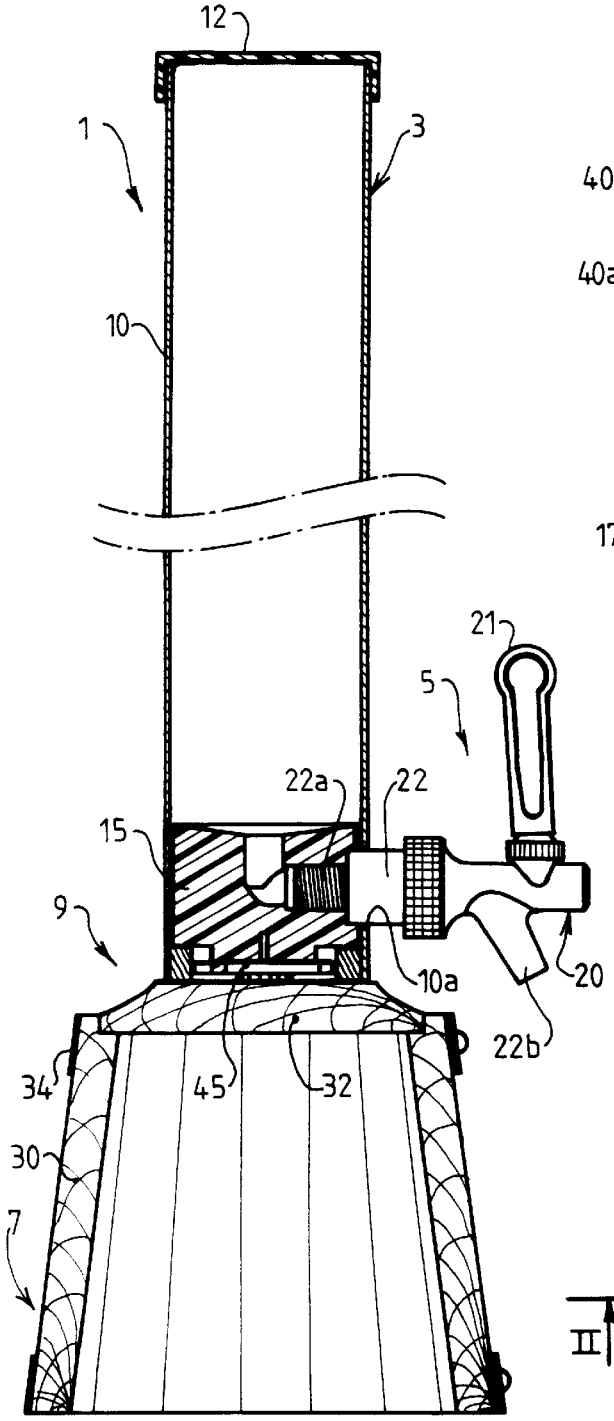
FIG. 1 is a fragmentary section view of a liquid dispenser of the invention.

The liquid dispenser 1 as shown in FIG. 1 comprises, in particular:

a container 3 for containing a volume of liquid;

a dispenser device 5 fitted to the container 3 to deliver fractions of the liquid stored in the container 3;

a base 7 supporting the container 3; and a fixing system 9 for mounting the container 3 in removable manner on the base 7.

The container 3 is shown as being in the form of a tube 10 of circular right section. An open end of the tube 10 or top end in FIG. 1 is closed by a removable cover 12. The other open end of the tube 10 or bottom end is closed in sealed manner by means of a bung 15.

The bung 15 is a circular part of diameter that is very accurately adjusted so that the bung 15 can be engaged as a leakproof tight fit against the inside wall of the tube 10. It is mounted inside the tube 10 by applying a small amount of force. Once received in the tube 10, the bung 15 has an inside face 15*a* that is to come into contact with the liquid, and an outside face 15*b*. Advantageously, the peripheral wall of the bung 15 has resilient lips 17 for improving the sealing between the tube 10 and the bung 15. The lips 17 are machined in the peripheral wall of the bung 15.

The device 5 for dispensing the liquid contained inside the container 3 is of conventional type and is constituted by an external cock 20 fitted with a control element 21. The cock 20 has a hollow body 22 that is open at both ends 22*a* and 22*b*. The end 22*a* of the hollow body 22 is externally threaded to be screwed into a tapped blind hole 24 penetrating laterally into the bung 15. The blind hole 24 communicates with a central blind hole penetrating into the bung 15 and opening out into the inside face 15*a* thereof. During mounting, the end 22*a* of the hollow body 22 passes freely through a through opening 10*a* in the wall of the tube 10. The control element 21 of the cock 20 controls a shutter (not shown) mounted inside the hollow body 22 to allow or prevent liquid from flowing between the tube 10 and the open end 22*b*.

The base 7 is constituted by a frustoconically-shaped part 30 having one end face closed by a circular plate 32. The frustoconical part 30 is assembled to the circular plate 32 by a hoop 34 so as to give the base 7 a barrel-like appearance, for example. The other end face of the part 30 is open so as to keep down the weight of the part.

In general, the fixing device 9 has a male portion M and a female portion F designed to be engaged one within the other. In the example shown in the figures, the male portion M is secured to the container 3 while the female portion F is secured to the base 7.

Figure 3:
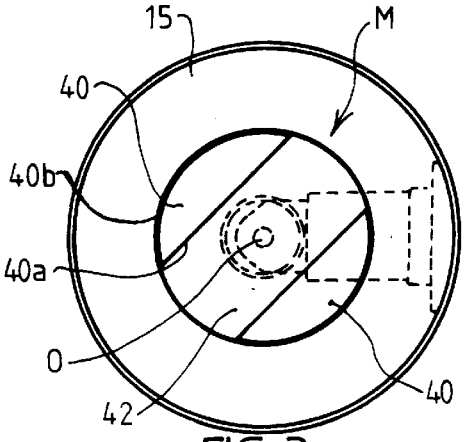
FIG. 3 is an end view of the container of the liquid dispenser.
Figure 2:
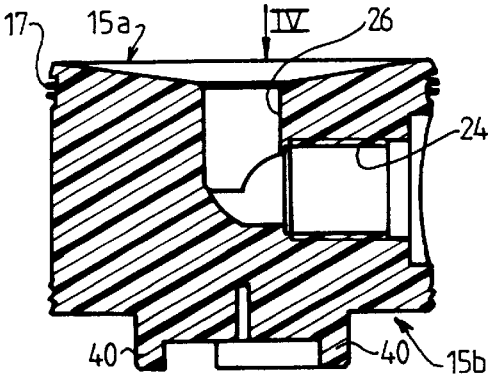
FIG. 2 is a section view on line II—II of FIG. 3.
Figure 4:
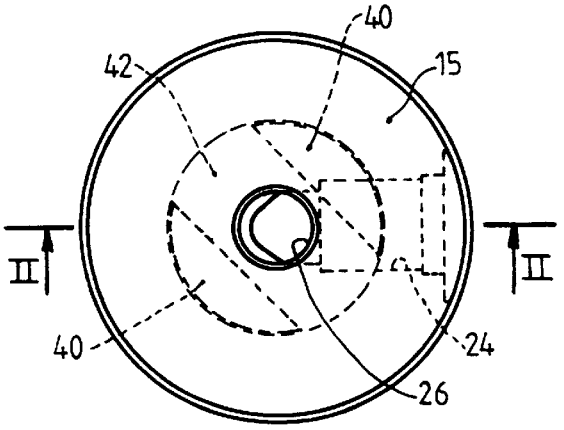
FIG. 4 is a view along arrow IV of FIG. 2.

With reference to FIGS. 2 to 4, the male portion M is constituted by two central projections 40 projecting from the outer face 15*b* of the bung 15. These two central projections 40 are symmetrical to each other about the center O of the face 15*b*. Each projection 40 is in the form of a circular segment having a rectilinear side 40*a* and a curved side 40*b*. The rectilinear sides 40*a* of the two projections 40 face each other, are parallel, and between them they define a rectilinear channel-section groove 42 which is open at both ends.

The male portion M has a rectangular-section strip 45 which is received in the groove 42 defined between the two central projections 40 of the bung 15. The strip 45 is fixed to the bung 15 by means of a screw 47 which passes through a central opening 48 in the strip 45. The length of the strip

45 is such that it projects from both ends of the groove 42 so as to form two lateral projections 45*a* that are in line with each other and that are situated at a distance from the outside face 15*b* of the bung 15. Nevertheless, the length of the strip 45 is shorter than the diameter of the bung 15.

Figure 5:
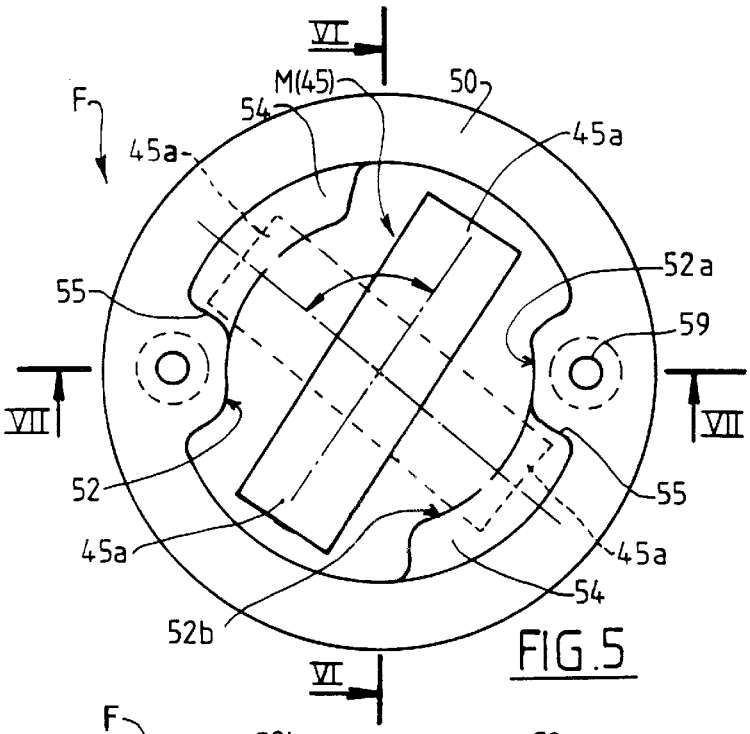
FIG. 5 is an end view of a part of the fixing system for fixing the container to a support base.
Figure 6:
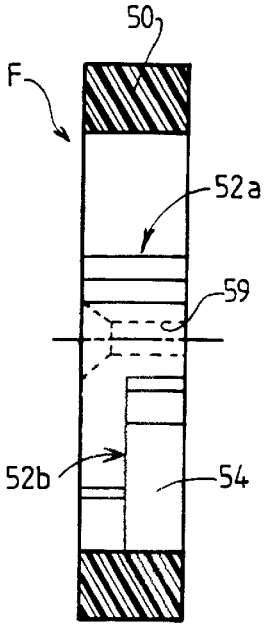
FIG. 6 is a section view on line VI—VI of FIG. 5.
Figure 7:
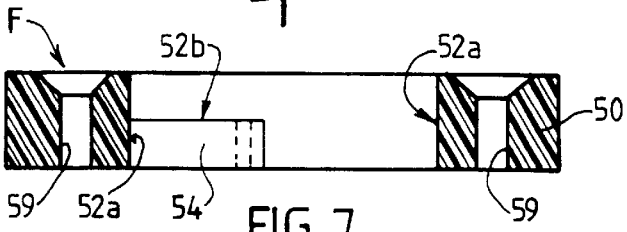
FIG. 7 is a section view on line VII—VII of FIG. 5.
Figure 8:
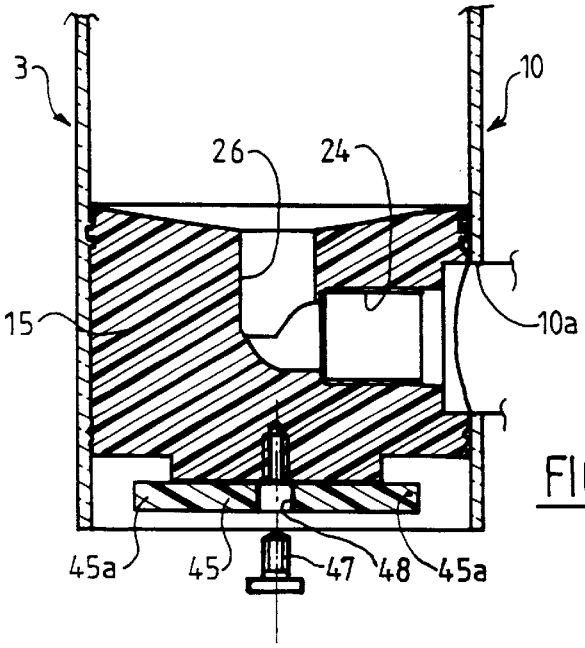
FIG. 8 is a diagrammatic section view for showing how the container is mounted on its support base.

With reference to FIGS. 5 to 7, the female portion F is constituted by an annular part comprising a ring 50 with two diametrically-opposite projections 52 projecting from its inside wall. Each projection 52 has a portion 52*a* which extends over the full height of the ring 50, and an adjacent portion 52*b* which extends over a portion only of the height of the ring 50, defining between them a cavity 54 and a shoulder 55. The two portions 52*a* of the two projections 52 are substantially diametrically opposite.

The female part F is fixed on the plate 32 of the base 7 by two screws 57 which pass through two holes 59 formed in the portions 52*a* of the projections 52. The female part F is mounted in such a manner that the two cavities 54 are directed towards the base 7.

The outside diameter of the ring 50 is greater than the inside diameter of the tube 10, and the inside diameter of the ring 50 is greater than the length of the strip 45 of the male portion M.

In general, the container 3 and the base 7 are assembled together while in mutual axial alignment. More precisely, with the base 7 placed on a horizontal support surface, the tube 10 is presented so as to insert the strip 45 that constitutes the male portion M freely into the female portion F, as shown in FIG. 5. Thereafter, it suffices to turn the tube 10 about its longitudinal axis to bring the two lateral projections 45*a* of the strip 45 into the two cavities 54 so as to prevent the tube 10 from moving axially relative to the base 7. The tube 10 is rotated through approximately 90° so that the two lateral projections 45*a* of the male portion come to bear against the shoulders 55 of the female portion F, as shown in dashed lines in FIG. 5.

To separate the tube 10 from the base, it suffices to rotate it in the opposite direction so as to disengage the lateral projections 45*a* from the cavities 54.

Naturally, variants can be envisaged that depart from the embodiment described above. In particular, the male portion M may be fixed to the base 7 and the female portion F may be fixed to the container 3.

In general, the container 3 is made of a material which is transparent so as to show the volume of liquid stored inside the container 3. The dispenser device 5 and the bung 15 are advantageously made of plastics materials. The male portion M of the fixing device 9 which is secured to the bung 15 can be integrally molded with the bung so that they constitute a single piece.

Advantageously, such a liquid dispenser 1 is portable. In use, the tube 10 is generally separated from the base 7 in order to proceed with a filling stage. The tube 10 can be of various capacities, for example its capacity may be of the order of a few liters. The tube 10 is then assembled onto its base while the base is placed on a table, and people situated around the table can pour varying quantities of liquid into their glasses by means of the cock 20.

What is claimed is:

1. A system for dispensing a liquid, in particular a beverage, the system comprising a container forming a supply of liquid and fitted with a dispenser device for delivering various quantities of liquid, said container comprising a tubular element, a bung enclosing said tubular element in a leakproof manner at one end, said bung having an inside face adjacent to the liquid and an outside face, a base for supporting the container, and a fixing device for fixing the container on the base, said fixing device comprising male and female portions of complementary shape secured respectively to the container and to the base, said male portion having at least two lateral projections and said female portion having at least two cavities for receiving the lateral projections of the male portion, said male and female portions cooperating with each other to enable at least relative rotary movement between the container and the base to secure them to each other or to release them from each other depending on the direction of rotation.

2. A dispenser system according to claim 1, wherein the male portion of the fixing device is constituted by at least one projection projecting from the outside face of the bung comprising two lateral elements in line with each other and situated at a distance from the outside face of the bung.

3. A dispenser system according to claim 2, wherein the projection is a central projection having a rectilinear transverse groove of channel section, and the two lateral projection elements are constituted by two end portions of a strip received in the groove and projecting from said groove.

4. A dispenser system according to claim 2, wherein the second means forming the female portion of the fixing device is constituted by an annular part fixed on the base and comprising a ring, and two diametrically-opposite central projections projecting from the inside wall of the ring, each projection having a first portion which extends over the full height of the ring and a second portion, only of the height of the ring, defining between them a cavity and a shoulder.

5. A dispenser system according to claim 4, wherein the female portion is fixed on the base in such a manner that the two cavities are directed towards the base.

6. A dispenser system according to claim 5, wherein the outside diameter of the ring of the female portion is greater than the inside diameter of the tube, and in that the inside diameter of the ring is greater than the length of the strip of the male portion.

7. A dispenser system according to claim 1, said bung has a peripheral wall engaging said tubular element, and including resilient lips on said peripheral wall for improving the sealing between said tubular element and said bung.

8. A dispenser system according to claim 7, wherein said resilient lips are machined in said peripheral wall of said bung.

* * * * *

UNITED STATES PATENT AND TRADEMARK OFFICE

CERTIFICATE OF CORRECTION

PATENT NO. : 6,053,367

DATED : April 25, 2000

INVENTOR(S) : Pejoine

It is certified that error appears in the above-identified patent and that said Letters Patent is hereby corrected as shown below:

Column 4, line 39, after "portion," insert --which extends over a portion--; line 46, cancel "in that".

Signed and Sealed this

Twentieth Day of February, 2001

*Attest:*

Nicholas P. Godici

NICHOLAS P. GODICI

*Attesting Officer*

*Acting Director of the United States Patent and Trademark Office*